United States Patent [19]

Janson et al.

[11] 3,992,896

[45] Nov. 23, 1976

[54] AIR CONDITIONING SYSTEM

[76] Inventors: August Janson, 45 Faversham Road, Canterbury, Victoria; Douglas John Chynoweth, 332 Maroondah Highway, Ringwood, Victoria, both of Australia

[22] Filed: Nov. 17, 1975

[21] Appl. No.: 632,827

Related U.S. Application Data

[63] Continuation-in-part of Ser. No. 499,851, Aug. 22, 1974, abandoned.

[30] Foreign Application Priority Data

Aug. 22, 1973 Australia ..... 4581/73

[52] U.S. Cl. ..... 62/238; 62/299; 62/324; 62/506

[51] Int. Cl.[2] ..... F25B 27/02; F25D 19/00; F25B 13/00; F25B 39/04

[58] Field of Search ..... 62/299, 506, 238, 324

[56] References Cited

UNITED STATES PATENTS

| | | | |
|---|---|---|---|
| 1,969,187 | 8/1934 | Schutt | 62/238 |
| 2,125,542 | 8/1938 | Catterlin | 62/299 |
| 2,150,993 | 3/1939 | Smith | 62/506 |
| 2,751,761 | 6/1956 | Borgerd | 62/238 |
| 3,188,829 | 6/1955 | Siewert et al. | 62/238 |
| 3,822,566 | 7/1974 | Lowi, Jr. | 62/324 |

FOREIGN PATENTS OR APPLICATIONS

| | | | |
|---|---|---|---|
| 407,611 | 3/1934 | United Kingdom | 62/506 |

*Primary Examiner*—Lloyd L. King
*Attorney, Agent, or Firm*—Cushman, Darby & Cushman

[57] ABSTRACT

An air-conditioner system including a movable unit which is deployed in the space to be heated or cooled by the system. The movable unit has a first heat exchanging apparatus, a second heat exchanging apparatus, a compressor, a fan operatively associated with said second heat exchanging apparatus, and a liquid source of either hot or cold liquid, the first heat exchanging apparatus being in heat exchanging relationship with the liquid source. An accessory heating element such as a heating coil is provided for heating liquid supplied to the liquid source. During enclosure cooling the first heat exchanging apparatus serves as a condenser, and during enclosure heating as an evaporator, and vice-versa for the second heat exchanging apparatus. A liquid supply system exterior of the enclosure provides liquid to the liquid source.

13 Claims, 3 Drawing Figures

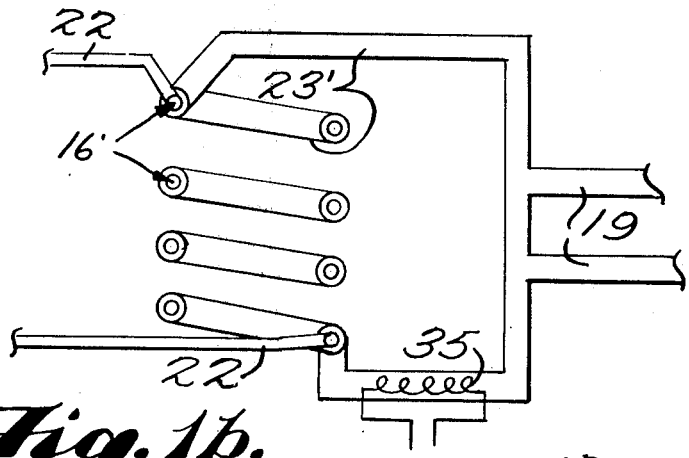
Fig. 1a.
Fig. 1b.
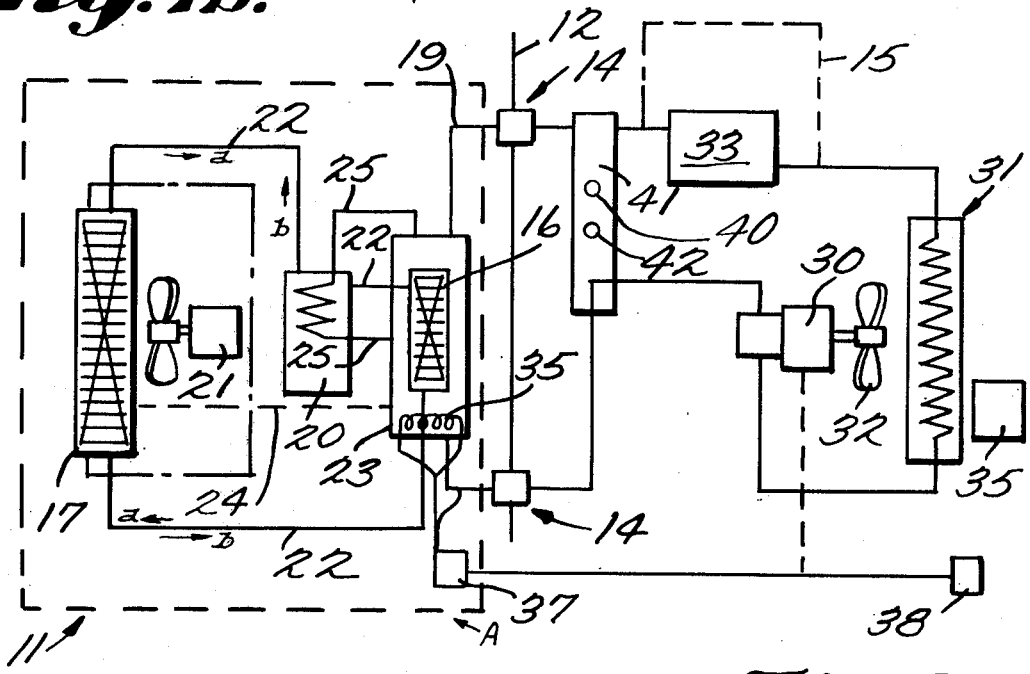
Fig. 2.
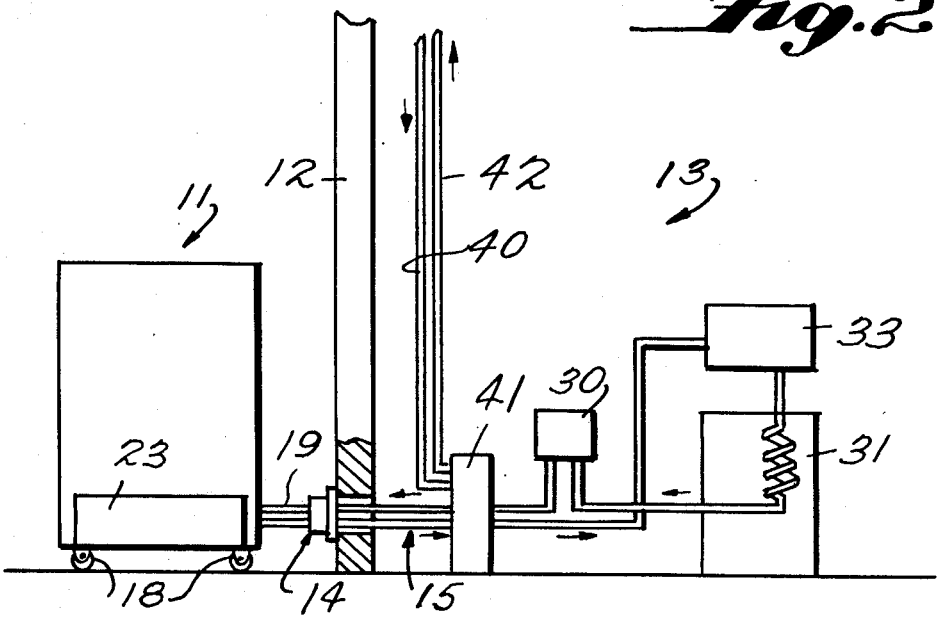

AIR CONDITIONING SYSTEM

CROSS-REFERENCE TO RELATED APPLICATIONS

This application is a continuation-in-part of U.S. application Ser. No. 499,851 filed Aug. 22, 1974 now abandoned.

BACKGROUND AND SUMMARY OF THE INVENTION

Heretofore, two kinds of refrigerated air-conditioning systems using one or more air-conditioning units of the refrigerant type have been widely used, package units, and room air-conditioning units. Package units, generally located on top of the building to be heated or cooled thereby, are most often used in large buildings, the cooled or heated air being ducted from the building-top location of the unit throughout the building. Room air-conditioning units are assembled in one or in two units, each requiring an outside fan air-cooled heat exchanger (acting alternatively as a condenser and evaporator), and which must be located in specific positions so as to utilize the outside (ambient) air, the units being either installed in a window or a short duct being provided between the units and an appropriate opening in a window or outside wall. Both of the above types of systems suffer from a number of disadvantages. For instance, package unit systems require extensive and costly ducting, the installation of which is not always possible in existing premises, and the room air-conditioning systems have substantial mobility limitations placed thereon, location in a window or external wall being necessary. Also, room systems are often noisy (often requiring two fans), and have little or no aesthetic appeal.

Other proposals have also been made for the utilization of portable air-conditioning units for cooling the inside of buildings, such as shown in U.S. Pat. No. 2,125,542, and proposals have also been made for the utilization of heat pumps for heating and cooling of buildings, such as shown in U.S. Pat. Nos. 2,751,761 and 3,188,829. Such proposals have not met with a great deal of practical success, however, probably due at least in part to the restriction of mobile in-room units to only cooling when utilized in large buildings, and the inefficiency of heat pumps for heating at low temperatures (i.e., below 6° C.), requiring an entire accessory heating system associated therewith.

According to the present invention, the above-mentioned drawbacks in prior art devices and proposals are eliminated, and a mobile in-room unit is provided that properly functions to provide both heat and cooling for an enclosure despite the size of the building within which the unit is functioning, and despite the ambient conditions, which unit also operates quietly and efficiently. According to the present invention, a mobile unit is provided having first and second heat exchanging means associated therewith, a compressor, a liquid source means of either hot or cold liquid (depending upon whether heating or cooling is to be effected) associated with the first heat exchanging means, a fan associated with the second heat exchanging means, and a heating coil for cooperating with the liquid source in heat-exchanging relationship with the first heat exchanging means during heating of the enclosure. Liquid source supply lines of a liquid supply system for feeding the source at least during enclosure cooling may be provided throughout the building and such lines may be connectable up with the mobile units for both heating and cooling. The heating coil or the like may be associated either externally of the mobile unit, in cooperation with the liquid source supply lines, or it may be enclosed within the mobile unit. When the liquid source includes a tank surrounding the first heat exchanging means, the condensate from the second heat exchanging means may be drained into said reservoir. The unit according to the present invention has the advantages of relatively silent operation, great mobility and flexibility in where it may be placed within an area to be heated, a lack of expensive ducting, and complete flexibility in heating and cooling the enclosure despite wide ranges of ambient temperature.

It is the primary object of the present invention to provide an improved mobile air-conditioning system including a mobile air-conditioner unit disposed within the enclosure to be heated or cooled. This and other objects of the invention will become clear from an inspection of the detailed description of the invention, and from the appended claims.

BRIEF DESCRIPTION OF THE DRAWINGS

FIG. 1*a* is a schematic view of an exemplary mobile air-conditioning system according to the present invention;

FIG. 1*b* is a schematic view of an alternative liquid source means that could be utilized with the arrangement of FIG. 1*a;* and FIG. 2 is a schematic elevational view of the general system shown in FIG. 1*a*.

DETAILED DESCRIPTION OF THE INVENTION

An exemplary system according to the present invention is shown schematically in FIGS. 1*a* and 2. The invention consists of two basic components, a mobile air-conditioner unit 11 disposed within an enclosure area A (on one side of an enclosure wall 12 or the like) to be heated or cooled thereby, and a liquid supply system 13 disposed exteriorly of enclosure area A (on the other side of an enclosure wall 12 or the like) for supplying liquid to the unit 11 during enclosure cooling or during enclosure cooling and heating. The mobile unit 11 is a self-contained unit mounted on casters 18 or the like and connected by lines 19 through a quick release coupling 14 or the like to lines 15 of exterior system 13.

The unit 11 contains at least five major components, a first heat exchanging means 16, a second heat exchanging means 17, a compressor 20, a liquid source means 23, and a fan 21. A refrigerant line 22 extends through the heat exchanging means 16, 17 and compressor 20 which compresses the refrigeration in the line 22 during operation of the unit 11. The fan 21 is operatively associated with the second heat exchanging means 17. The liquid source means 23 is in heat exchanging relationship with the first heat exchanging means 16. During cooling of the enclosure area A, the first means 16 serves as a condenser while the second means 17 serves as an evaporator, and during the heating of enclosure area A the first means 16 serves as an evaporator while the second means 17 serves as a condenser. The liquid source means 23 places cooling liquid in heat exchanging relationship with the means 16 during enclosure cooling, and places heating liquid in heat exchanging relationship with the means 16 during enclosure heating. The liquid source means preferably comprises a tank (as shown in FIG. 1*a*) containing the first heat exchanging means 16 immersed therein, however, it may take other suitable forms such as a coil 23' (as shown in FIG. 1*b*) in concentric relationship with the coil 16' of heat exchanging means 16. Such a relationship is shown in more detail in U.S. Pat. No. 2,150,993.

When the liquid source means 23 is a tank, as shown in FIG. 1*a*, condensate from the evaporator of the system 1 can be drained directly into it as by line 24 (see dotted line in FIG. 1*a*), and the liquid from the source means 23 can be used to cool the compressor 20, via cooling line 25, if desired, especially during enclosure cooling.

The liquid supply system 13 provides cooling liquid to the liquid source means 23, and also supplies heating liquid to the means 23 in some embodiments of the present invention. The system 13 includes a pump 30, a heat exchanger 31 in the ambient air, and a fan 32 associated with heat exchanger 31 (and which may be commonly driven with pump 30), all connected by the liquid supply lines 15 which are connectable through connections 14 with lines 19 of the unit 11. A liquid reservoir 33 is also provided in lines 15, either in series (solid line in FIG. 1*a*), or in parallel (dotted line in FIG. 1*a*). An overflow 34 for reservoir 33 preferably is provided. When the condensate from the evaporator 17 drains into the tank 23, in order to avoid draining the entire system through either the open condensate drain in tank 23 or the overflow 34 or reservoir 33 when the system is at rest, the tank 23 and reservoir 33 must be disposed at the same height. Where height equalization is not possible (i.e. a split level home), all the condensate from either one or all points can be run directly into a drain (at connection 14). During enclosure area A cooling, liquid flowing through lines 15 is cooled at heat exchanger 31, cooling being facilitated by fan 32, and is supplied to and withdrawn from liquid source 23, 23', thereby cooling the refrigerant in condenser (first heat exchanging means) 16 disposed in heat-exchanging relationship with source 23. The refrigerant then flows in direction A to evaporator (second heat exchanging means) 17 which has enclosure air blowing thereacross by fan 21 to provide enclosure air cooling, and then to compressor 20 to be compressed, and back to condenser 16. When the ambient temperature is above a certain minimum T (about 6° C), the same system may be used for enclosure A heating, liquid in lines 15 flowing through heat exchanger 31 being heated by the ambient air, and then flowing to source 23 wherein it heats the refrigerant in evaporator 16. From evaporator 16 the refrigerant flows in the direction of arrows B (reverse to the direction of arrows A) to compressor 20 where it is compressed, to condenser 17 wherein its heat is released into the enclosure air (facilitated by fan 21), and back to evaporator 16. Reversal of refrigerant flow can be effected by any suitable conventional means.

In addition to the above-mentioned structure, according to the preferred embodiment of the present invention a heating coil 35 (which may be an electric resistance heating element or the like) is associated with the system to provide for heating of the enclosure area A, either providing heat at all ambient temperatures during enclosure heating to heat the liquid in source 23, or providing heat to the system only after the ambient temperature drops below a certain minimum T (about 6° C). The heating coil 35 or the like may be located in operative association with heat exchanger 31 (it may be positioned between fan 32 and heat exchanger 31 if desired), or preferably it may be located directly in tank 23, or in concentric line 23'. If immersed in liquid, of course, it is desirable that the coil 35 have an electrically insulating (but heat conducting) means disposed therearound for safety purposes. A control means 37 may be operatively associated with the coil 35 and a temperature sensing means 38. When the ambient temperature drops below the temperature T, the control 37 automatically starts operation of the coil 35. When the coil 35 is directly associated with liquid source 23 (being disposed in unit 11), the control 37 will also stop operation of the pump 30 and fan 32, however, when the coil 35 is associated with heat exchanger 31, the pump 30 will continue in operation, and perhaps the fan 32 also (depending upon the location of coil 35 relative to heat exchanger 31 and fan 32).

In order to allow for the installation of multiple liquid supply and outlet connections, a manifold 41 with liquid supply line 42 and return line 40 is provided. The above multiple connections enable the movable unit to be deployed and connected in any selected enclosure within a building thereby ensuring the use of only one unit to condition a number of enclosures within such a building.

It will thus be seen that according to the present invention a mobile air conditioning system has been provided that does not have the drawbacks of a high noise level, excessive wastage of water, restriction of location, expensive ducting, or costly multiple individual units, and inefficient heating operation at low ambient temperatures (or the necessity of an entirely different heating means), that are inherent in prior art structures. While the invention has been herein shown and described in what is presently conceived to be the most practical and preferred embodiments of the invention, it will be apparent to one of ordinary skill in the art that many modifications may be made thereof within the scope of the invention, which scope is to be accorded the broadest interpretation of the appended claims so as to encompass all equivalent structures and devices.

What is claimed is:

1. A mobile air-conditioning system for cooling and heating an enclosed area comprising a. a mobile refrigerant air-conditioner unit movably disposed within said enclosed area to be cooled or heated, said unit including (i) a first heat exchanging means, having refrigerant circulating therethrough, for serving as a condenser during enclosure cooling and serving as an evaporator during enclosure heating, (ii) a second heat exchanging means having refrigerant circulating therethrough and operatively connected to said first heat exchanging means and for serving as an evaporator during enclosure cooling and as a condenser during enclosure heating, (iii) a fan operatively cooperating with said second heat exchanging means, (iv) a compressor operatively cooperating with said first and second heat exchanging means for compressing refrigerant circulating therethrough, and (v) a liquid source means in heat exchanging relationship with said first heat exchanging means for placing cooling liquid in heat exchanging relationship with said first heat exchanging means to cool the refrigerant therein during enclosure cooling and for placing heating liquid in heat exchanging relationship with said first heat exchanging means to heat the refrigerant therein during enclosure heating, b. a liquid supply system located exteriorly of said enclosure for supplying liquid to said liquid source means at least during enclosure cooling, and c. a heating coil or the like for heating liquid in or supplied to said liquid source means.

2. A mobile air conditioning unit as recited in claim 1 wherein said liquid source means comprises a liquid tank containing said first heat exchanging means.

3. A mobile air-conditioning unit as recited in claim 2 wherein said heating coil or the like is disposed within said liquid tank containing said first heat exchanging means.

4. A mobile air-conditioning unit as recited in claim 3 wherein said liquid system comprises a pump, a heat exchanger, a fan for facilitating cooling of liquid flowing through said heat exchanger when cooling of said enclosure is desired, and liquid supply lines leading from said liquid supply system through an enclosure wall to said liquid tank containing said first heat exchanging means.

5. A mobile air-conditioning unit as recited in claim 4 wherein said heat exchanger in said liquid supply system facilitates heating of the liquid flowing therethrough for enclosure heating when the ambient temperature is above a certain temperature T, and further comprising control means for stopping operation of said pump in said liquid supply system and beginning operation of said heating coil when the ambient temperature drops below the temperature T.

6. A mobile air-conditioning unit as recited in claim 5 wherein said temperature T is about 6° C.

7. A mobile air-conditioning unit as recited in claim 2 wherein said liquid supply system comprises a pump, a heat exchanger, a fan associated with said heat exchanger for facilitating cooling of liquid flowing through said heat exchanger when cooling of said enclosure is desired, and liquid supply lines leading from said liquid supply system through an enclosure wall to said liquid reservoir containing said first heat exchanging means.

8. A mobile air-conditioning unit as recited in claim 7 wherein said liquid supply system further includes a liquid reservoir disposed in series or parallel in the liquid supply line leading to said heat exchanger of said liquid supply lines.

9. A mobile air-conditioning unit as recited in claim 8 wherein said second heat exchanging means drains into said liquid tank when serving as an evaporator, and wherein said tank and said liquid reservoir are located at the same height.

10. A mobile air-conditioning unit as recited in claim 7 wherein said heating coil or the like is associated with said heat exchanger of said liquid supply system for heating liquid flowing through said heat exchanger when heating of said enclosure is desired.

11. A mobile air-conditioning unit as recited in claim 7 wherein a quick-release coupling at an enclosure wall is provided between said liquid supply lines of said liquid supply system and lines leading to said liquid tank.

12. A mobile air-conditioning unit as recited in claim 2 wherein said compressor is cooled by liquid circulating from said tank in a closed system.

13. A mobile air-conditioning unit as recited in claim 1 wherein said liquid source means comprises a liquid conducting coil concentric with a refrigerant coil of said first heat exchanging means.

* * * * *